US007131273B2

(12) United States Patent
Howell et al.

(10) Patent No.: US 7,131,273 B2
(45) Date of Patent: Nov. 7, 2006

(54) GAS TURBINE ENGINE CARBURETOR WITH FLAT RETAINER CONNECTING PRIMARY AND SECONDARY SWIRLERS

(75) Inventors: Stephen John Howell, West Newbury, MA (US); Jennifer Caiulo, Marblehead, MA (US); Robert Gregory Carita, Needham, MA (US)

(73) Assignee: General Electric Company, Schenectady, NY (US)

( * ) Notice: Subject to any disclaimer, the term of this patent is extended or adjusted under 35 U.S.C. 154(b) by 201 days.

(21) Appl. No.: 11/015,780

(22) Filed: Dec. 17, 2004

(65) Prior Publication Data

US 2006/0130483 A1 Jun. 22, 2006

(51) Int. Cl.
*F23R 3/14* (2006.01)
*F02C 1/00* (2006.01)

(52) U.S. Cl. ..... 60/748

(58) Field of Classification Search ..... 60/748, 60/740; 239/403, 399
See application file for complete search history.

(56) References Cited

U.S. PATENT DOCUMENTS 5,117,637 A 6/1992 Howell et al.
6,314,739 B1 11/2001 Howell et al.
2005/0044854 A1* 3/2005 Cazalens et al. ..... 60/740
2006/0042268 A1* 3/2006 Markarian et al. ..... 60/796

* cited by examiner

*Primary Examiner*—Ehud Gartenberg
(74) *Attorney, Agent, or Firm*—William Scott Andes; Steven J. Rosen

(57) ABSTRACT

A gas turbine engine combustor carburetor includes forward and aft air swirlers. The aft swirler has a septum defining a primary venturi and a plurality of circumferentially spaced aft swirl vanes. The forward swirler has a plurality of circumferentially spaced forward swirl vanes extending forwardly from a flat annular radial flange of the forward swirler, an annular wall extending forwardly from a forward face of the septum and radially bounding an annular recess on the forward face, and the radial flange slidably retained within the annular recess and against the septum by a flat retainer attached to the annular wall of the septum. The flat retainer may be produced by stamping. An anti-rotation tab on the radial flange of the forward swirler extends radially through a corresponding notch in the annular wall.

16 Claims, 3 Drawing Sheets

GAS TURBINE ENGINE CARBURETOR WITH FLAT RETAINER CONNECTING PRIMARY AND SECONDARY SWIRLERS

BACKGROUND OF THE INVENTION

1. Field of the Invention

This invention relates to carburetors for gas turbine engine combustors and, more particularly, to such carburetors having primary and secondary air swirlers and designed for mounting in combustor domes.

2. Description of Related Art

Gas turbine engine combustors include carburetors for mixing fuel with compressed air to form an air/fuel mixture for combustion in a combustion zone of the combustor. One type of conventional gas turbine engine combustor includes radially spaced outer and inner combustor liners surrounding the combustion zone and joined at an upstream end thereof by a combustor dome. The combustor dome is typically made of sheet metal and is part of a combustor dome assembly that includes a plurality of circumferentially spaced carburetors therein, with each carburetor including a fuel injector for providing fuel and an air swirler for providing swirled air for mixing with the fuel for creating a fuel/air mixture discharged into the combustion zone between the two liners.

The mixture is burned for generating combustion gases which flow downstream or aftwardly through the combustor to a turbine nozzle suitably joined to the aft end of the combustor. Immediately downstream of the turbine nozzle is a high-pressure turbine which extracts energy from the combustion gases for powering a compressor disposed upstream of the combustor which provides compressed air to the engine.

Each of the carburetors includes forward and aft air swirlers respectively, also referred to as primary and secondary swirlers, respectively, having a longitudinal carburetor axis. The aft swirler includes a septum which defines a primary venturi of the carburetor. The aft swirler includes a plurality of circumferentially spaced aft swirl vanes and an annular exit cone, all formed together in an integral casting. The forward swirler includes a ferrule for slidably supporting a fuel injector. The forward swirler includes a plurality of circumferentially spaced forward swirl vanes and a flat annular radial flange attached thereto.

The radial flange of the forward swirler is slidably retained against a forward facing surface of the septum of the aft swirler by a retainer attached to the septum. The retainer has a wide aperture in the middle allowing it to slide over the forward swirl vanes and engage an outer edge of the flat annular radial flange which is wider than the aperture. A ridge along a periphery of the retainer extends aftwardly from an aft face of the retainer. A small notch machined into the ridge receives a narrow anti-rotation tab extending radially outwardly from a periphery of the radial flange of the forward swirler.

The ridge of the retainer is brazed, welded, or otherwise bonded or attached to the forward facing surface of the septum. This secures the forward swirler to the aft swirler while allowing for differential thermal growth between the fuel injector and the combustor dome while preventing relative rotation between the forward and aft swirlers. This helps set, control, and maintain desirable Pattern Factors.

The retainer is formed from a retainer casting and its final shape including the ridge and notch features are machined into the retainer casting. The primary swirler typically has a narrow anti-rotation tab that engages the notch to prevent relative rotation between the primary and secondary swirlers. The narrow tab is subject to fretting from engine cycles and, thus, prone to failure. The primary and secondary swirlers and the retainer are delicate and prone to damage during fabrication and from handling during assembly and maintenance and from engine operating loads. The primary and secondary swirlers and retainer plate are extensively machined at their mating surfaces which is costly. It is, thus, desirable to provide a carburetor and its parts that are not as delicate and prone to damage during fabrication and from handling and during engine operation from vibratory engine operating loads.

SUMMARY OF THE INVENTION

A gas turbine engine combustor carburetor includes forward and aft air swirlers. The aft swirler has a septum defining a primary venturi and a plurality of circumferentially spaced aft swirl vanes. The forward swirler has a plurality of circumferentially spaced forward swirl vanes extending forwardly from a flat annular radial flange of the forward swirler. The aft swirler includes an annular wall extending forwardly from a forward face of the septum and radially bounding an annular recess on the forward face. The radial flange of the forward swirler is slidably retained within the annular recess and against the septum by a flat retainer attached to the annular wall of the septum. The flat retainer may be produced by stamping.

An exemplary embodiment of the carburetor includes an anti-rotation tab on the radial flange of the forward swirler that extends radially through a corresponding notch in the annular wall. More particular embodiments of the anti-rotation tab are rectangular in shape and have a width at least 33% of a forward swirler flange diameter of the forward swirler or at least 20% of the forward swirler flange diameter or in a range of between 20%–33% of the forward swirler flange diameter. Yet, more particular embodiments of the anti-rotation tab have a width of at least 0.2 inches.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
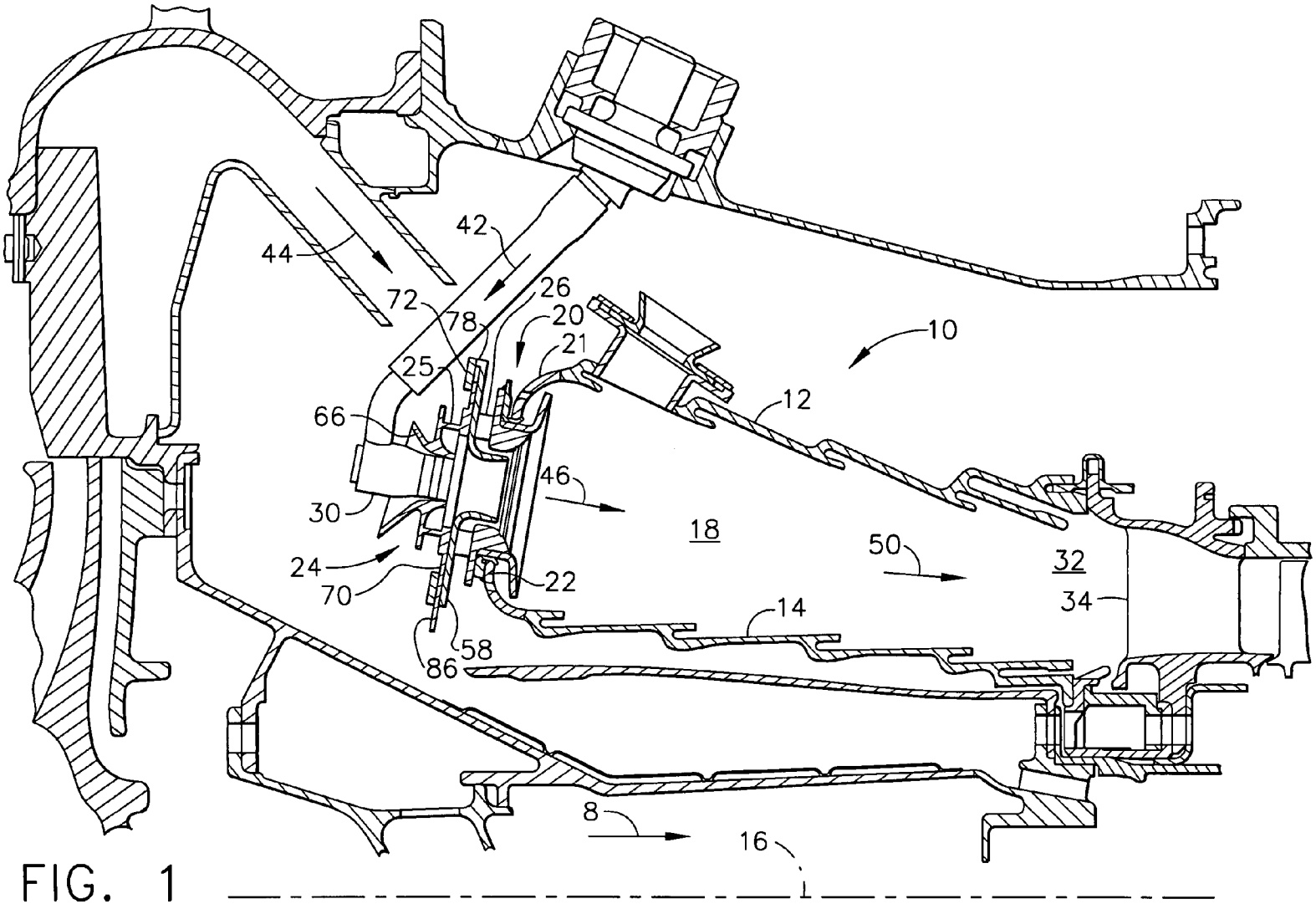
FIG. 1 is a centerline sectional view illustration of a gas turbine engine combustor section and adjacent structure including an exemplary embodiment of a carburetor with a flat retainer in a dome assembly of the combustor.

Illustrated in FIG. 1 is an exemplary embodiment of a combustor dome assembly 20 in a gas turbine engine combustor 10. The combustor 10 includes a pair of film-cooled radially outer and inner annular liners 12 and 14 disposed coaxially about a longitudinal engine centerline 16, about which the gas turbine engine and the combustor 10 are circumscribed, extending in an aft or downstream direction 8. The outer and inner liners 12 and 14 are spaced from each other to define therebetween a combustion zone 18.

At its upstream end, the combustor 10 includes the dome assembly 20 having an annular combustor dome 21 with an annular dome plate 22 at its upstream end and disposed coaxially about the centerline 16 which is conventionally fixedly connected to upstream ends of the liners 12 and 14. The annular dome plate 22 is a forward substantially conical portion of the annular combustor dome 21. The combustor dome assembly 20 includes a plurality of circumferentially spaced carburetors 24 which are additionally shown in FIG. 2.

Figure 2:
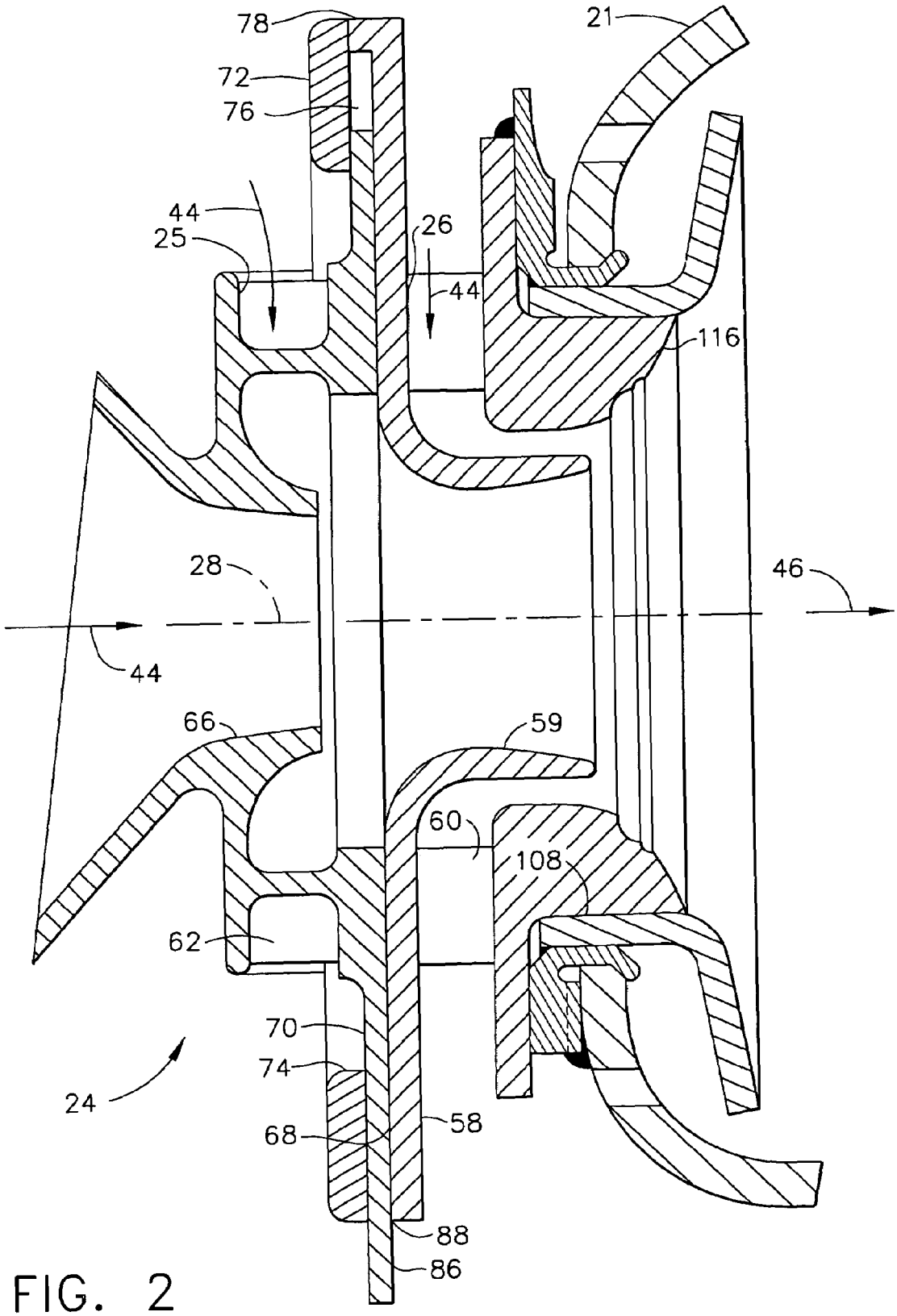
FIG. 2 is an enlarged sectional view illustration through a centerline axis of the carburetor illustrated in FIG. 1.

Illustrated in FIG. 2 is an enlarged sectional view of the carburetor 24 disposed through a circular opening 108 in the dome assembly 20 about the engine centerline 16. Each of the carburetors 24 includes forward and aft air swirlers 25 and 26, respectively, having a longitudinal carburetor axis 28. The forward and aft air swirlers 25 and 26 are also referred to primary and secondary swirlers, respectively. The aft air swirler 26 includes an annular exit cone 116. The aft swirler 26 includes a septum 58 which defines a primary venturi 59, a plurality of circumferentially spaced aft swirl vanes 60, and an annular exit cone 116, all formed together in an integral casting.

The forward swirler 25 centrally supports a ferrule 66 for slidably supporting a fuel injector 30 (see FIG. 1) therein. The forward swirler 25 has a plurality of circumferentially spaced forward swirl vanes 62 extending forwardly or upstream from a flat annular radial flange 70 attached thereto. The fuel injector 30 and the aft swirler 26 are disposed coaxially with the carburetor axis 28. The forward and aft swirlers 25 and 26 are retained to each other by a flat retainer 72. The exemplary embodiment of the flat retainer 72 illustrated herein is a flat stamped part instead of a fully machined part as was used in the past. Producing the flat retainer 72 by stamping results in a costs savings over cast and machined retainers as has been used in the past.

Figure 3:
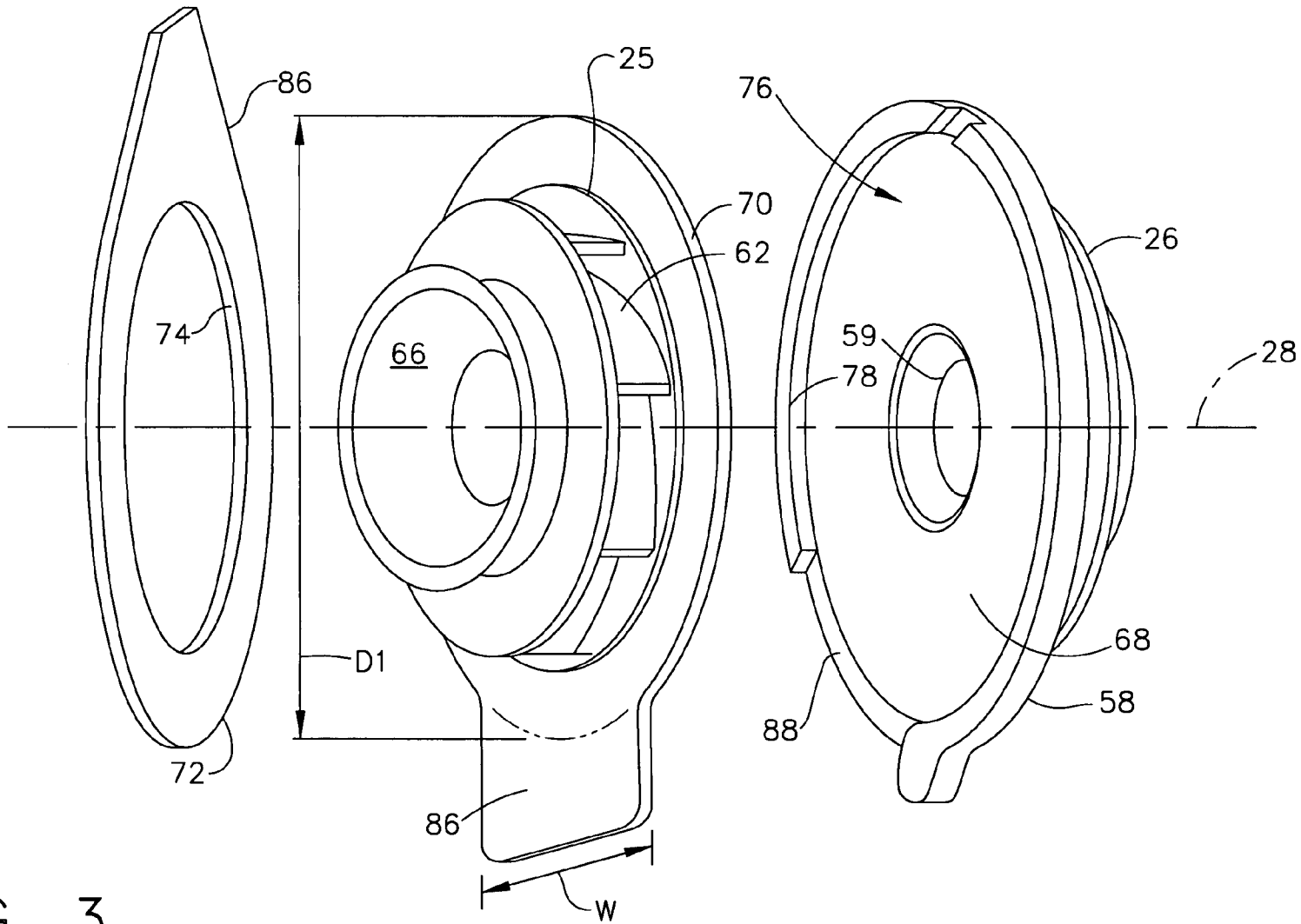
FIG. 3 is an exploded perspective view of the flat retainer and primary and secondary swirlers in the carburetor illustrated in FIG. 2.

Illustrated in greater detail in FIG. 3 is the flat retainer 72 and the forward and aft swirlers 25 and 26. A retainer aperture 74 centered in the flat retainer 72 is wide enough to fit over the primary swirler 25 but not wider than the radial flange 70 attached to the forward swirl vanes 62. The radial flange 70 seats within an annular recess 76 on a forward face 68 of the septum 58. An annular wall 78 extending forwardly from the forward face 68 of the septum 58 radially bounds the annular recess 76. The radial flange 70 is slidably retained within the annular recess 76 and against the septum 58 by a flat retainer 72 attached to the annular wall 78 of the septum 58. The radial flange 70 has a wide anti-rotation tab 86 that extends radially through a corresponding wide notch 88 in the annular wall 78 to prevent rotation between the forward and aft swirlers 25 and 26. The flat retainer 72 axially and radially retains the radial flange 70 within an annular recess 76 and holds the forward and aft swirlers 25 and 26 together.

The wide anti-rotation tab 86 has a tab width W in a preferential range of about 20% to 33% of a forward swirler flange diameter D1 of the forward swirler 25. Wider anti-rotation tab 86 also allows more economical gang grinding operation to be used in the manufacturing process. A wide anti-rotation tab 86 having the tab width W in excess of 33% of the forward swirler flange diameter D1 provides manufacturing benefits, but durability is probably not significantly enhanced over one with a tab width of 20% of the forward swirler flange diameter D1. It is also recommended that the tab width W not be less than 0.2 inches. Narrow tabs in past designs have been in a range of 7% to 17%.

Referring back to FIGS. 1 and 2, the combustor 10 includes at its downstream end, an annular combustor outlet 32 and is conventionally connected to a conventional turbine nozzle 34, which includes a plurality of circumferentially spaced nozzle vanes. In operation, fuel 42 is conventionally channeled through the injector 30 and discharged therefrom into the forward and aft air swirlers 25 and 26 wherein it is mixed with a portion of compressed air 44 conventionally provided to the combustor 10 from a compressor (not shown). The swirlers 25 and 26 are effective for mixing the fuel 42 and the air 44 for creating a fuel/air mixture 46, which is discharged into the combustion zone 18, where it is conventionally ignited by a conventional igniter (not shown) disposed through the outer liner 12. Combustion gases 50 are generated and are channeled from the combustion zone 18 to the combustor outlet 32, to the turbine nozzle 34, and then to turbine stages which extract energy therefrom for powering compressor and fan stages of the engine disposed upstream of the combustor 10.

The present invention has been described in an illustrative manner. It is to be understood that the terminology which has been used is intended to be in the nature of words of description rather than of limitation. While there have been described herein, what are considered to be preferred and exemplary embodiments of the present invention, other modifications of the invention shall be apparent to those skilled in the art from the teachings herein and, it is, therefore, desired to be secured in the appended claims all such modifications as fall within the true spirit and scope of the invention.

Accordingly, what is desired to be secured by Letters Patent of the U.S. is the invention as defined and differentiated in the following claims.

What is claimed is:

1. A gas turbine engine combustor carburetor comprising:

forward and aft air swirlers having a longitudinal carburetor axis therethrough, the aft swirler including a septum defining a primary venturi and a plurality of circumferentially spaced aft swirl vanes, the forward swirler including a plurality of circumferentially spaced forward swirl vanes extending forwardly from a flat annular radial flange of the forward swirler, an annular wall extending forwardly from a forward face of the septum radially bounding an annular recess on the forward face, and the radial flange being slidably retained within the annular recess and against the septum by a flat retainer attached to the annular wall of the septum.

2. A carburetor as claimed in claim 1 further comprising the flat retainer having been produced by stamping.

3. A carburetor as claimed in claim 1 further comprising an anti-rotation tab on the radial flange extending radially through a corresponding notch in the annular wall.

4. A carburetor as claimed in claim 3 further comprising the anti-rotation tab being rectangular in shape and having a width at least 33% of a forward swirler flange diameter of the forward swirler.

5. A carburetor as claimed in claim 3 further comprising the anti-rotation tab being rectangular in shape and having a width at least 20% of a forward swirler flange diameter of the forward swirler.

6. A carburetor as claimed in claim 3 further comprising the anti-rotation tab being rectangular in shape and having a width in a range of between 20%–33% of a forward swirler flange diameter of the forward swirler.

7. A carburetor as claimed in claim 3 further comprising the anti-rotation tab being rectangular in shape and having a width the greater of at least 33% of a forward swirler flange diameter of the forward swirler or 0.2 inches.

8. A carburetor as claimed in claim 3 further comprising the anti-rotation tab being rectangular in shape and having a width the greater of at least 20% of a forward swirler flange diameter of the forward swirler or 0.2 inches.

9. A carburetor as claimed in claim 3 further comprising the anti-rotation tab being rectangular in shape and having a width the greater of a range of between 20%–33% of a forward swirler flange diameter of the forward swirler or 0.2 inches.

10. A carburetor as claimed in claim 3 further comprising the flat retainer having been produced by stamping.

11. A carburetor as claimed in claim 10 further comprising the anti-rotation tab being rectangular in shape and having a width at least 33% of a forward swirler flange diameter of the forward swirler.

12. A carburetor as claimed in claim 10 further comprising the anti-rotation tab being rectangular in shape and having a width at least 20% of a forward swirler flange diameter of the forward swirler.

13. A carburetor as claimed in claim 10 further comprising the anti-rotation tab being rectangular in shape and having a width in a range of between 20%–33% of a forward swirler flange diameter of the forward swirler.

14. A carburetor as claimed in claim 10 further comprising the anti-rotation tab being rectangular in shape and having a width the greater of at least 33% of a forward swirler flange diameter of the forward swirler or 0.2 inches.

15. A carburetor as claimed in claim 10 further comprising the anti-rotation tab being rectangular in shape and having a width the greater of at least 20% of a forward swirler flange diameter of the forward swirler or 0.2 inches.

16. A carburetor as claimed in claim 10 further comprising the anti-rotation tab being rectangular in shape and having a width the greater of a range of between 20%–33% of a forward swirler flange diameter of the forward swirler or 0.2 inches.

* * * * *